US007387211B2

(12) United States Patent
Anspach

(10) Patent No.: US 7,387,211 B2
(45) Date of Patent: Jun. 17, 2008

(54) FOLDING NESTING BUNGEE CORD CARRIER WITH PACKING WINDOWS

(76) Inventor: Royal B. Anspach, 5433 E. Yolantha St., Cave Creek, AZ (US) 85331

( * ) Notice: Subject to any disclaimer, the term of this patent is extended or adjusted under 35 U.S.C. 154(b) by 46 days.

(21) Appl. No.: 11/248,002

(22) Filed: Oct. 11, 2005

(65) Prior Publication Data

US 2007/0080119 A1 Apr. 12, 2007

(51) Int. Cl.
*A47F 7/00* (2006.01)

(52) U.S. Cl. ..... 211/13.1

(58) Field of Classification Search ..... 211/13.1, 211/195, 181.1, 198, 60.1, 61, 85; 206/443, 206/805; 220/6, 4.01
See application file for complete search history.

(56) References Cited

U.S. PATENT DOCUMENTS 1,332,146 A * 2/1920 Riordan et al. ..... 223/68
5,507,399 A * 4/1996 Hermanson ..... 211/181.1
5,971,172 A * 10/1999 Cockerham ..... 211/181.1
6,099,060 A * 8/2000 Towers ..... 294/159

* cited by examiner

*Primary Examiner*—Sarah Purol
(74) *Attorney, Agent, or Firm*—Tod R. Nissle, P.C.

(57) ABSTRACT

A carrier for bungee cords folds and nests such that bungee cords mounted on one portion of the carrier interfit with bungee cords on another portion of the carrier to facilitate the compact storage and transport of the bungee cords.

1 Claim, 2 Drawing Sheets

FOLDING NESTING BUNGEE CORD CARRIER WITH PACKING WINDOWS

This invention pertains to carriers for elongate, pliable cords.

More particularly, the invention relates to carriers for elongate, elastic bungee cords of varying lengths.

A variety of bags, racks, tubes, boxes and other containers have been utilized to package and store bungee cords, rope, electrical cords and other elongate cord items.

U.S. Pat. No. 6,099,060 discloses a unitary rack for storing cord, namely bungee cords.

U.S. Pat. No. 5,139,208 discloses another unitary rack for storing cord.

U.S. Pat. No. D415,952 discloses a further unitary rack for storing cord, namely extension cord.

U.S. Pat. No. 1,297,959 disclose still another unitary rack for storing cord, namely chalk line.

U.S. Pat. No. 6,286,777 discloses yet another rack for storing cord, namely extension cord.

U.S. Pat. No. 4,277,035 discloses still yet another rack for storing cord, namely extension cord.

U.S. Pat. No. 4,193,563 discloses a further rack for storing cord, namely extension cord.

An object of conventional cord storage racks is to conveniently store flexible cord in a compact manner in a relatively small space. In pursuing this object, it is commonly intended that the cord be stored in tension and snugly wrapped about a storage rack such that the cord cannot flop or move about. It is believed that loosely wrapping flexible cord, in particular bungee cords, is desirable and can facilitate the compact storage of the same.

Therefore, it an object of the instant invention to provide an improved storage rack for pliable cord material.

In a further respect, it is an object of the invention to provide an improved storage rack for bungee cords in which storing the bungee cords in a loose configuration facilitates storage of the bungee cords.

Figure 1:
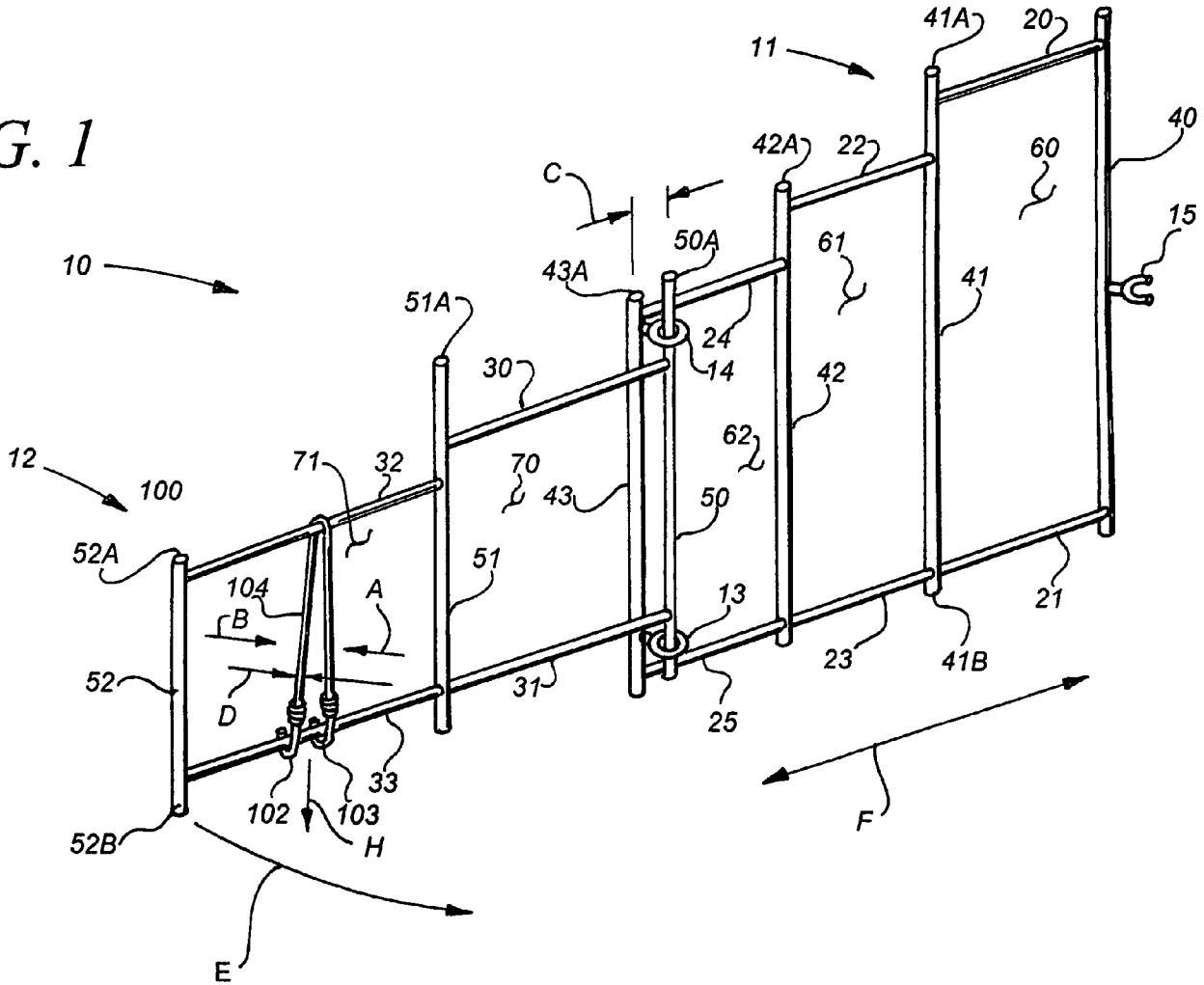
Figure 2:
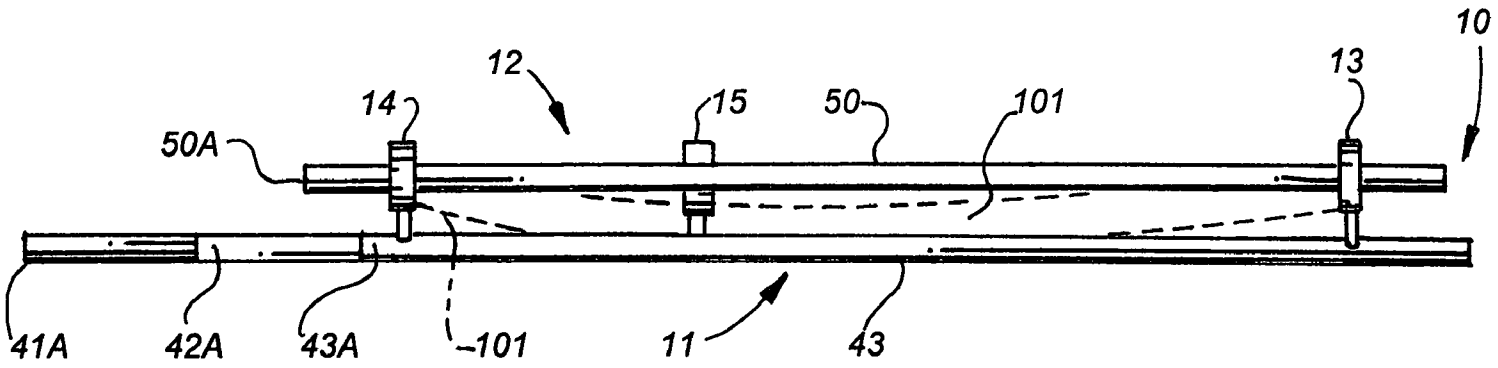

These and other, further and more specific objects of the invention will be apparent from the following description, taken in conjunction with the drawings, in which:

FIG. 1 is a perspective view illustrating a bungee cord storage rack constructed in accordance with the principles of the invention and in a deployed configuration; and, FIG. 2 is a side view of the bungee cord storage rack of FIG. 1 in a folded configuration.

Briefly, in accordance with the invention, I provide an improved carrier for elongate elastic cords each having a pair of ends each provided with a fastener. The carrier includes a first frame assembly including at least a pair of elongate cross arms for supporting elastic cords extending in a transverse direction between said arms. The cross arms bound in part an open window extending between the cross arms. Each of the cross arms is capable of engaging the fasteners of a cord such that when the end of one cord engages one of the cross arms and the cord is folded around the other of the cross arms such that the opposite end of the same cord engages the one of the cross arms, the cord is supported without being tensioned, and the cord extends from the one of the cross arms to the other of the cross arms through the open window. The carrier also includes a second frame assembly pivotally connected to the first frame assembly and including at least a second pair of elongate cross arms for supporting elastic cords extending in a transverse direction between the second pair of arms.

In another embodiment of the invention, I provide an improved carrier for elongate elastic cords each having a pair of ends each provided with a fastener. The carrier comprises a first frame assembly including at least a pair of elongate cross arms for foldably supporting elastic cords extending in a transverse direction between the arms. The cross arms bound in part an open window extending between the cross arms. Each of the cross arms is capable of engaging the fasteners of a first cord having a first unstretched length such that when the end of the first cord engages one of the cross arms and the cord is folded around the other of the cross arms the opposite end of the same cord engages the one of the cross arms. The carrier also comprises a second frame assembly pivotally foldably connected to the first frame assembly and including at least a second pair of elongate cross arms for foldably supporting elastic cords extending in a transverse direction between the second pair of arms. The second pair of cross arms bounding in part a second open window extending between the second pair of cross arms. Each of the second pair of cross arms is capable of engaging the fasteners of a second cord having a second unstretched length less than the first unstretched length such that when the end of a second cord engages one of the second pair of cross arms and the cord is folded around the other of the second pair of cross arms the opposite end of the same cord engages the one of the cross arms. The second frame is shaped and dimensioned such then when the second frame is folded, said second open window is at least partially positioned directly above the first open window such that portions of the second cord extend into the first window.

In a further embodiment of the invention, I provide an improved method for storing elongate elastic cords each having a pair of ends each provided with a fastener. The improved method comprises the step of providing a carrier. The carrier includes a first frame assembly including at least a pair of elongate cross arms for foldably supporting elastic cords extending in a transverse direction between the arms. The cross arms bound in part an open window extending between the cross arms. Each of the cross arms is capable of engaging the fasteners of a cord such that when the end of one cord engages one of the cross arms and the cord is folded around the other of the cross arms such that the opposite end of the same cord engages the one of the cross arms, the cord is supported without being tensioned, and the cord extends from the one of the cross arms to the other of the cross arms through the open window. The carrier also includes a second frame assembly pivotally connected to the first frame assembly and including at least a second pair of elongate cross arms for foldaby supporting elastic cords extending in a transverse direction between the second pair of arms. The method also comprises the steps of folding a first cord about the first pair of elongate cross arms; and, folding a second cord about the second pair of elongate cross arms.

Turning now to the drawings, which illustrate the presently preferred embodiment of the invention for purpose of illustration thereof and not by way of limitation, and in which like reference characters refer to like features throughout the several views, FIG. 1 illustrates a bungee cord carrier constructed in accordance with the invention and generally indicated by reference character 10. Carrier 10 includes a first frame 11 and a second frame 12. Frame 12 is foldably, pivotally connected to frame 11.

Frame 11 includes elongate cross arms 20 to 25 and includes elongate transversal legs 40 to 43. Each leg 40 to 43 interconnects an associated leg pair 20-21, 22-23, 24-25. Spaced apart, parallel, opposing cross arms 20 and 21 bound and circumscribe and enclose in part open window space 60. Arms 20 and 21 are interconnected by transversal legs 40 and 41. Legs 40 and 41 also bound and circumscribe, in part, space 60. Spaced apart, parallel, opposing cross arms 22 and 23 bound and circumscribe and enclose in part open window space 61. Arms 22 and 23 are interconnected by transversal legs 41 and 42. Legs 41 and 42 also bound and circumscribe and enclose, in part, space 61. Spaced apart, parallel, opposing cross arms 24 and 25 bound and circumscribe and enclose in part open window space 62. Arms 24 and 25 are interconnected by transversal legs 42 and 43. Legs 42 and 43 also bound and circumscribe and enclose, in part, space 62.

U-shaped latch 15 is fixedly mounted on transversal leg 40. Eyelet members 13 and 14 are fixedly mounted on transversal leg 43 and each rotatably receive a different end of transversal leg 50.

Transversal legs 40 to 43 have end portions 41A to 43A, 41B that extend outwardly past their associated cross arms 20, 22, 24, 21, 23. These end portions 41A to 43A, 41B function as stops that prevent bungee cords mounted on carrier 10 from sliding laterally in the directions indicated by arrows F off an arm 20, 22, 24, 21, 23.

The distance between cross arm pair 22-23 is less than the distance between cross arm pair 20-21. The distance between cross arm pair 24-25 is less than the distance between cross arm pair 22-23.

Frame 12 includes elongate cross arms 30 to 33 and includes elongate transversal legs 50 to 52. Spaced apart, parallel, opposing cross arms 30 and 31 bound and circumscribe and enclose in part open window space 70. Arms 30 and 31 are interconnected by transversal legs 50 and 51. Legs 50 and 51 also bound and circumscribe, in part, space 70. Spaced apart, parallel, opposing cross arms 32 and 33 bound and circumscribe and enclose in part open window space 71. Arms 32 and 33 are interconnected by transversal legs 51 and 52. Legs 51 and 52 also bound and circumscribe and enclose, in part, space 71.

Transversal legs 50 to 52 have end portions 50A to 52A, 52B that extend outwardly past their associated cross arms 30, 32, 33. These end portions 50A to 52A, 52B function as stops that prevent bungee cords mounted on carrier 10 from sliding laterally in the directions indicated by arrows F off an arm 30, 32, 33.

The distance between cross arm pair 30-31 is less than the distance between cross arm pair 24-25. The distance between cross arm pair 32-33 is less than the distance between cross arm pair 32-33.

Frame 12 is folded onto frame 11 by pivoting frame 12 in the direction of arrow E until frame 12 is above frame 11 and arms 30 to 33 are substantially parallel to arms 20 to 25. When frame 12 is folded in the direction indicated by arrow E, the ends of transversal leg 50 pivot in eyelets 13 and 14. When frame 12 is folded onto frame 11, arms 30 to 33 lie between arm pair 20-21, arm pair 22-23, and/or arm pair 24-25, and, consequently frame 11 nests on frame 12 intermediate the upper arms 20, 22, 24 and the lower arms 21, 23, 25.

Eyelets 13, 14 or other members that pivotally interconnect frames 11 and 12 are fabricated such that the distance C between arms 43 and 50 permits frame 12 to be substantially parallel to frame 11 when frame 12 is folded over onto frame 11 (or vice-versa). Further, the distance C permits a portion 101 (FIG. 2) of a bungee cord mounted on frame 12 to extend into a window space 60 to 62 of frame 11, preferably even in the event that the bungee cord is tensioned on frame 12. Likewise, the distance C may permit a portion of a bungee cord mounted on frame 11 to extend into a window space 70 or 71, especially if the bungee cord is not tensioned. The portion of a bungee cord extending into a window space 60 to 62 can be a portion of the elongate stretchable part 104 of the bungee cord or can be a portion of a fastener 102, 103. In FIG. 1, the fasteners 102 and 103 comprise conventional U-shaped hooks. The shape and dimension and construction and functioning of fasteners 102 and 103 can vary as desired.

One important feature of the invention consists of determining the distance between an opposing pair of arms 32, 33 that will permit a bungee cord 100 having a particular length to be folded substantially in half in the manner illustrated in FIG. 1 such that when fasteners 102 and 103 engage the same arm 33, the bungee cord 100 is preferably not tensioned and actually hangs loosely around arms 32, 33. Even though the cord 100 is not tensioned or hangs loosely around arms 32 and 33, the cord does not come off because moving a fastener 102, 103 outwardly a sufficient distance to clear and move free of arm 33 would require that the stretchable part 104 of the cord be tensioned, stretched and lengthened. Consequently, removal of the bungee cord requires a user to grasp an end and pull the end outwardly in the direction of arrow H; otherwise, the bungee cord 100 remains mounted about arms 32 and 33. When a bungee cord is mounted in this loose and/or non-tensioned manner and frame 12 is folded into parallel relationship with frame 11, portions of the bungee cord can extend into a window 60 to 62 and can squeeze or slide and slip or interfit between bungee cords mounted on 12 to facilitate the compact storage of bungee cords. This configuration makes better use of the window spaces 60 to 62 (and 70 and 71) circumscribed by arm 20-21, 22-23, 24-25 and leg 40-41, 41-42, 42-43 combinations.

When a bungee cord 100 is loosely foldably mounted on a pair of opposed, spaced apart arms 32 and 33, then when lateral forces A, B are applied to the cord 100, these forces will more readily laterally displace the stretchable portions of cord 100 and will facilitate the interfitting of a cord 100 on frame 12 with a cord or cords on frame 11 when frame 11 is folded into substantially parallel relationship with frame 12, and will facilitate movement of a portion of a cord on frame 12 into an opposing window on frame 11. Lateral forces A, B can be generated by the gravity acting on cord 100, by a user gently pressing against a cord 100, by an object set on cord 100, etc.

The distances between arm pairs 32-33, 30-31, 24-25, 22-23, and 20-21 varies so that bungee cords of varying length can be foldably mounted on carrier 10 in the folded, and preferably non-tensioned, configuration illustrated in FIG. 1 for bungee cord 100.

When frame 12 is pivotally moved in the direction of arrow E into parallel relationship with frame 11, a portion of arm 52 in the center of arm 52 seats in U-shaped clip 15. Although not a requirement, clip 15 is preferred because it is shaped and dimensioned to maintain a distance between arms 40 and 52 that is equivalent to the distance C between arms 43 and 50.

To facilitate nesting, the length of each leg 51, 52 is preferably less than the distance between arms 24 and 25, or at least less than the distance between arms 22 and 23, so that when frame 12 is folded onto frame 11 the end of a leg 51, 52 will not contact an arm 20 to 25. This facilitates the sliding over and interfitting of portions of bungee cords on frame 12 with portions of bungee cords on frame 11. If there are only bungee cords on frame 12 and none on frame 11 (or vice-versa), or if bungee cords on frame 12 have no opposing bungee cords on frame 11 when frame 12 is folded into parallel relationship with frame 11, then portions of bungee cords on frame 12 readily extend into a window 60 to 62 on frame 11 to facilitate the nesting of frame 12 with frame 11.

When a bungee cord is stretched from its normal at rest unstretched configuration, the width or diameter, indicated by arrows D in FIG. 1, of the bungee cord is typically reduced. In the practice of the invention, it is preferred that when a bungee cord is mounted on the carrier of FIG. 1, the diameter of the stretchable resilient portion of the bungee cord be equivalent to the diameter of the cord when it is in its normal at rest unstretched configuration.

The materials comprising the arms and legs of carrier 10 can vary as desired, as can the shape and dimension of said arms and legs. It is preferred, however, that the arms and legs be comprised of wire or elongate tubular material having a diameter or width of one-quarter inch or less, preferably three-sixteenths of an inch or less, and most preferably one-eighth of an inch or less. Using such material minimizes the weight of carrier 10. Since bungee cords preferably are not tightly tensioned on carrier 10, it is not necessary for the carrier to have excessive structural strength. This enables the carrier 10 to be unusually light and to be fabricated from a variety of materials including plastic.

Having described my invention in such terms as to enable those of skill in the art to make and practice it, and having described the presently preferred embodiments thereof, I Claim:

1. A method for storing elongate elastic cords each having a pair of ends each provided with a hook fastener, comprising the steps of (a) providing a carrier including (i) a first frame assembly including a first orthogonal opening bounded by a first pair of spaced apart parallel elongate cross arms for foldably supporting elastic cords extending in a transverse direction between said arms and bounded by a first pair of spaced apart parallel elongate transverse arms each extending between and connected to said first pair of spaced apart parallel elongate cross arms, a second orthogonal opening adjacent said first orthogonal opening and bounded by a second pair of spaced apart parallel elongate cross arms for foldably supporting elastic cords extending in a transverse direction between said second pair of cross arms and bounded by a second pair of spaced apart parallel elongate transverse arms each extending between and connected to said first pair of spaced apart parallel elongate cross arms, said first pair of spaced apart cross arms being spaced apart a greater distance than said second pair of spaced apart cross arms, one of said first pair of cross arms being co-linear with one of said second pair of cross arms, said first pair of cross arms being capable of engaging the fasteners of a cord such that when one hook fastener end of a first elastic cord having a selected length engages one of said cross arms of said first pair and the cord is folded around the other of said cross arms of said first pair the other hook fastener end the same cord engages said one of said cross arms, said first cord being temporarily tensioned to mount said end of said first cord on said one of said cross arms of said first pair, said first cord not being tensioned after being foldably mounted on said first pair of cross arms, said second pair of cross arms being capable of engaging the fasteners of a second elastic cord of a selected length such that when one hook fastener end of the cord engages one of said cross arms of said second pair and the cord is folded around the other of said cross arms of said second pair the other hook fastener end of said second cord engages said one of said cross arms of said second pair, said second cord being temporarily tensioned to mount said end of said second cord on said one of said cross arms of said second pair, said second cord not being tensioned after being foldably mounted on said second pair of cross arms, (ii) a second frame assembly including a third orthogonal opening bounded by a third pair of spaced apart parallel elongate cross arms for foldably supporting elastic cords extending in a transverse direction between said third pair of cross arms and bounded by a third pair of spaced apart parallel elongate transverse arms each extending between and connected to said third pair of spaced apart parallel elongate cross arms, said third pair of spaced apart cross arms being spaced apart a greater distance than said second pair of spaced apart cross arms, a fourth orthogonal opening adjacent said first orthogonal opening and bounded by a fourth pair of spaced apart parallel elongate cross arms for foldably supporting elastic cords extending in a transverse direction between said fourth pair of cross arms and bounded by a fourth pair of spaced apart parallel elongate transverse arms each extending between and connected to said fourth pair of spaced apart parallel elongate cross arms, said fourth pair of spaced apart cross arms being spaced apart a greater distance than said third pair of spaced apart cross arms, one of said third pair of cross arms being co-linear with one of said fourth pair of cross arms, said third pair of cross arms being capable of engaging the fasteners of a cord such that when one hook fastener end of a third elastic cord having a selected length engages one of said cross arms of said third pair and the cord is folded around the other of said cross arms of said third pair the other hook fastener end of said third cord engages said one of said third pair of cross arms, said third cord being temporarily tensioned to mount said ends of said first cord on said one of said cross arms of said third pair, said third cord not being tensioned after being foldably mounted on said third pair of cross arms, said fourth pair of cross arms being capable of engaging the fasteners of a fourth elastic cord of a selected length such that when one hook fastener end of said third cord engages one of said cross arms of said fourth pair of cross arms and said fourth cord is folded around the other of said cross arms of said fourth pair the other hook fastener end of said fourth cord engages said one of said cross arms of said fourth pair, said fourth cord being temporarily tensioned to mount said hook fastener ends of said fourth cord on said one of said cross arms of said fourth pair, said fourth cord not being tensioned after being foldably mounted on said fourth pair of cross arms, (iii) at least a pair of pivots mounted on said carrier and interconnecting and spacing apart one of said arms in said second pair of transverse arms and one of said arms in said third pair of transverse arms such that said first frame can pivot between at least two operative positions, an open operative position, and a closed operative position with said second frame generally parallel to and spaced apart from said first frame and with said first pair of transverse arms each offset from and spaced apart from said third pair of transverse arms, (iv) at least one stop spaced apart from said pivots, spaced apart from said arms of said second and third pairs of transverse arms that are interconnected by said pivots, mounted on said carrier, and when said first frames is in said closed operative position, spacing apart one of said arms in said first frame from one of said arms in said second frame to maintain, along with said pivots, said first and second frames in spaced apart parallel relationship, second frame to maintain, along with said pair of pivots, said first and second frames in generally parallel spaced apart relationship with one of each of said first pairs of arms parallel to and spaced apart from a different one of each of said primary pairs of arms;

(b) deploying said carrier with said first frame in said open operative position;

(c) folding said first elastic cord about said first pair of elongate cross arms and temporarily tensioning said first elastic cord to engage both of the hook fasteners on said first elastic cord on the same one of said first pair of elongate cross arms, said first elastic cord not being tensioned after being mounted on said first pair of elongate cross arms; and, (d) moving said first frame from said first to said second operative position.

* * * * *